US005227231A

United States Patent [19]

Yoshizaki et al.

[11] Patent Number: 5,227,231

[45] Date of Patent: Jul. 13, 1993

[54] ELECTRICAL RESISTIVE MATERIAL

[75] Inventors: Sadao Yoshizaki; Kazuya Nishimura; Masami Kawabayashi, all of Kyoto, Japan

[73] Assignee: Susumu Co., Ltd., Kyoto, Japan

[21] Appl. No.: 816,673

[22] Filed: Jan. 3, 1992

[30] Foreign Application Priority Data

Jun. 19, 1991 [JP] Japan ..... 3-176146

[51] Int. Cl.[5] ..... H01C 7/00

[52] U.S. Cl. ..... 428/336; 501/96; 501/105; 501/127; 501/132; 501/153; 428/469; 428/472; 428/698; 428/701; 428/704

[58] Field of Search ..... 428/469, 472, 457, 698, 428/701, 704, 336; 346/76 PH; 420/422, 428, 528, 552, 588; 501/96, 105, 127, 132, 153

[56] References Cited

U.S. PATENT DOCUMENTS 4,835,548 5/1989 Nikadio et al. ..... 346/76 PH

FOREIGN PATENT DOCUMENTS 62-165302 7/1987 Japan .

287501 3/1990 Japan .

OTHER PUBLICATIONS

Journal of Applied Physcis, 54(10), Oct. 1983, pp. 5705-5710, R. R. Ruf, et al., "Extremely High Corrosion Resistance in Amorphous Cr—B Alloys".

Journal of the Japan Institute of Metals, vol. 53, No. 11, 1989, pp. 1177-1183, Sadao Yoshizaki, et al., "Electrical Properties of Evaporated Thin Films of Cr—Al—B Alloy".

*Primary Examiner*—Ellis P. Robinson
*Assistant Examiner*—A. A. Turner
*Attorney, Agent, or Firm*—Oblon, Spivak, McClelland, Maier & Neustadt

[57] ABSTRACT

An electrical resistive material used for making e.g. a heating element for a thermal printing element. It is a Cr—Al—B—Zr—O alloy and is composed of a quaternary alloy and 15 to 25 at % of oxygen, wherein the quaternary alloy is composed of 2 to 25 at % of zirconium and a ternary alloy containing 35 to 55 at % of chromium, 2 to 23 at % of aluminium and 37 to 58 at % of boron.

3 Claims, 6 Drawing Sheets

ELECTRICAL RESISTIVE MATERIAL

BACKGROUND OF THE INVENTION

1. Field of the Invention

This invention relates to an electrical resistive material used to make, for example, a heating element for a thermal printing element.

2. Description of the Prior Art

There are known thin film resistive materials, such as a nickel-chromium alloy and a tantalum compound, which are used for thin film resistors. These materials, however, have a resistivity which is as low as about 0.2 mΩ·cm, and it has, therefore, been difficult to make small resistors, such as chip resistors, having high resistance. The known chip resistors, for example, have only a maximum resistance of several tens to one hundred kilohms.

There are also known several kinds of thin film materials developed for making heating elements for thermal printing elements, and having a higher resistivity. These materials, however, have a very high temperature coefficient of resistance (TCR) in the order of several hundred ppm/° C. which is too high for any precision resistor. For example, a known Ta—Si—C alloy has a temperature coefficient of resistance which is as high as about −600 ppm/° C., though it has a relatively high resistivity of about 4.2 mΩ·cm.

Yoshizaki, one of the inventors of this invention, et al. have developed an amorphous electrical resistive material composed of a Cr—Al—B ternary alloy and oxygen in order to overcome the drawbacks of the known materials as described above. This material is used for making thin film chip resistors and heating elements for thermal printing elements. It is produced by adding 10 to 30 at % (atomic %) of oxygen to a ternary alloy obtained by adding 30 to 70 at % of boron to a chromium-aluminium alloy containing 10 to 40 at % of aluminium, and is disclosed in the Japanese Patent Laying-Open Gazette No. 2-87501, laid open on Mar. 28, 1990. This material has, however, been found still unsatisfactory, since it undergoes crystallization and has a lower electric resistance when exposed to a high temperature. When it is used to make a heating element for a thermal printing element which will be exposed to a high temperature, it has been necessary to thermally treat it at a higher temperature to make a thermally stable heating element. The heat treatment has not only meant extra work, but also brought about a change in resistance of the material which is difficult to control.

SUMMARY OF THE INVENTION

It is, therefore, a principal object of this invention to provide an electrical resistive material which is high in resistivity and heat resistance and has a relatively low temperature coefficient of resistance.

This object is essentially attained by an electrical resistive material composed of a quaternary alloy and 15 to 25 at % of oxygen, wherein the quaternary alloy is obtained by adding 2 to 25 at % of zirconium to a ternary alloy containing 35 to 55 at % of chromium, 2 to 23 at % of aluminium and 37 to 58 at % of boron.

The principal advantage of this invention resides in the provision of an electrical resistive material which is high in resistivity and heat resistance and has a relatively low temperature coefficient of resistance. While a heating element for a thermal printing element which is formed from a thin film of a nickel-chromium alloy has a maximum resistance of only several hundred ohms, a heating element formed from a thin film of the material of this invention has a resistance of several thousand ohms and thereby enables the use of a smaller driving circuit and a smaller power source. While a heating element for a thermal printing element which is formed from a Cr—Al—B ternary alloy not containing zirconium has a working temperature of only 500 ° C. at maximum, the material of this invention can make a heating element having a working temperature which is at least 200 ° C. higher than 500 ° C., and enabling a higher speed of printing.

It is another advantage of this invention that the formation of a thin film of the material on an electrical insulating substrate enables not only a high degree of integration by fine working, but also a high electric resistance.

Other objects and advantages of the present invention will become apparent from the detailed description to follow taken in conjunction with the appended claims.

DETAILED DESCRIPTION

The electrical resistive material of this invention is composed of chromium, aluminium, boron, zirconium and oxygen. More specifically, it is composed of a Cr—Al—B—Zr quaternary alloy and 15 to 25 at % of oxygen (i.e. 15 to 25 at % of oxygen based on the total of chromium, aluminium, boron, zirconium and oxygen) wherein the Cr—Al—B—Zr quaternary alloy is obtained by adding 2 to 25 at % of zirconium (i.e. 2 to 25 at % of zirconium based on the total of chromium, aluminium, boron and zirconium) to a ternary alloy containing 35 to 55 at % of chromium, 2 to 23 at % of aluminium and 37 to 58 at % of boron.

Figure 1:
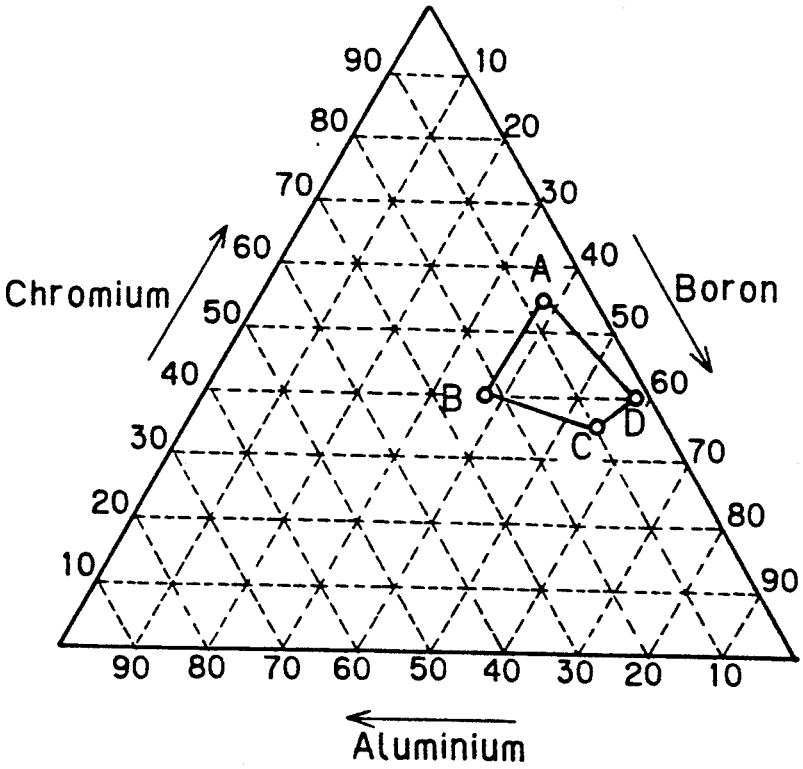
FIG. 1 is a diagram showing the composition of a Cr—Al—B ternary alloy to which zirconium is added to compose the electrical resistive material of this invention.

The ternary alloy has a composition (at % of chromium, aluminium and boron, respectively) falling within the area defined by four points A (55, 7, 38), B (40, 23, 37), C (35, 10, 55) and D (40, 2, 58) in FIG. 1. The quaternary alloy has a composition obtained by adding 2 to 25 at % of zirconium to the composition defined by the area A-B-C-D.

The ternary alloy contains 2 to 23 at % of aluminium. If its aluminium content is less than 2 at %, there will be obtained only a material of low resistivity. If it exceeds 23 at %, there will be obtained a material having a great change in electric resistance when heat treated.

The ternary alloy contains 37 to 58 at % of boron. If its boron content is less than 37 at %, there will be obtained a material of low resistivity. If it exceeds 58 at %, there will be obtained a material having an extremely low environmental resistance.

The quaternary alloy contains 2 to 25 at % of zirconium. If its zirconium content is less than 2 at %, a thin film of the alloy having a thickness of 20 nm will have an extremely low electric resistance when heat treated. If its zirconium content exceeds 25 at %, a thin film having a thickness of 100 nm will undesirably increase its electric resistance when heat treated.

The material of this invention contains 15 to 25 at % of oxygen. If its oxygen content is less than 15 at %, the material will have an undesirably low resistivity, and if it exceeds 25 at %, the material will have an extremely high negative temperature coefficient of resistance.

The invention will now be described in further detail with reference to specific examples.

Thin films of electrical resistive materials of Cr—Al—B—Zr—O having different compositions were deposited on ceramic substrates by sputtering with an argon gas containing oxygen from a quasi-quaternary alloy target prepared by laying fragments of zirconium on the surface of a target of a ternary alloy containing 46 at % of chromium, 7 at % of aluminium and 47 at % of boron. Examination was made of the electrical properties of the thin films to determine the effect which the proportion of zirconium added to a Cr—Al—B ternary alloy might have on their electrical properties.

The composition of the Cr—Al—B ternary alloy was controlled by placing particles of chromium, aluminium or boron on the target carrying fragments of zirconium, and the proportion of zirconium relative to the ternary alloy was controlled by varying the number of its fragments on the target. The density of oxygen in the argon gas was fixed, so that the density of oxygen took in the films might be controlled to be constant.

Although the thin films were formed by reactive sputtering employing an argon gas containing oxygen, it is also possible to form thin films by ordinary sputtering employing pure argon and a target composed of oxides of chromium, aluminium, boron or zirconium, or by vacuum deposition.

Figure 2:
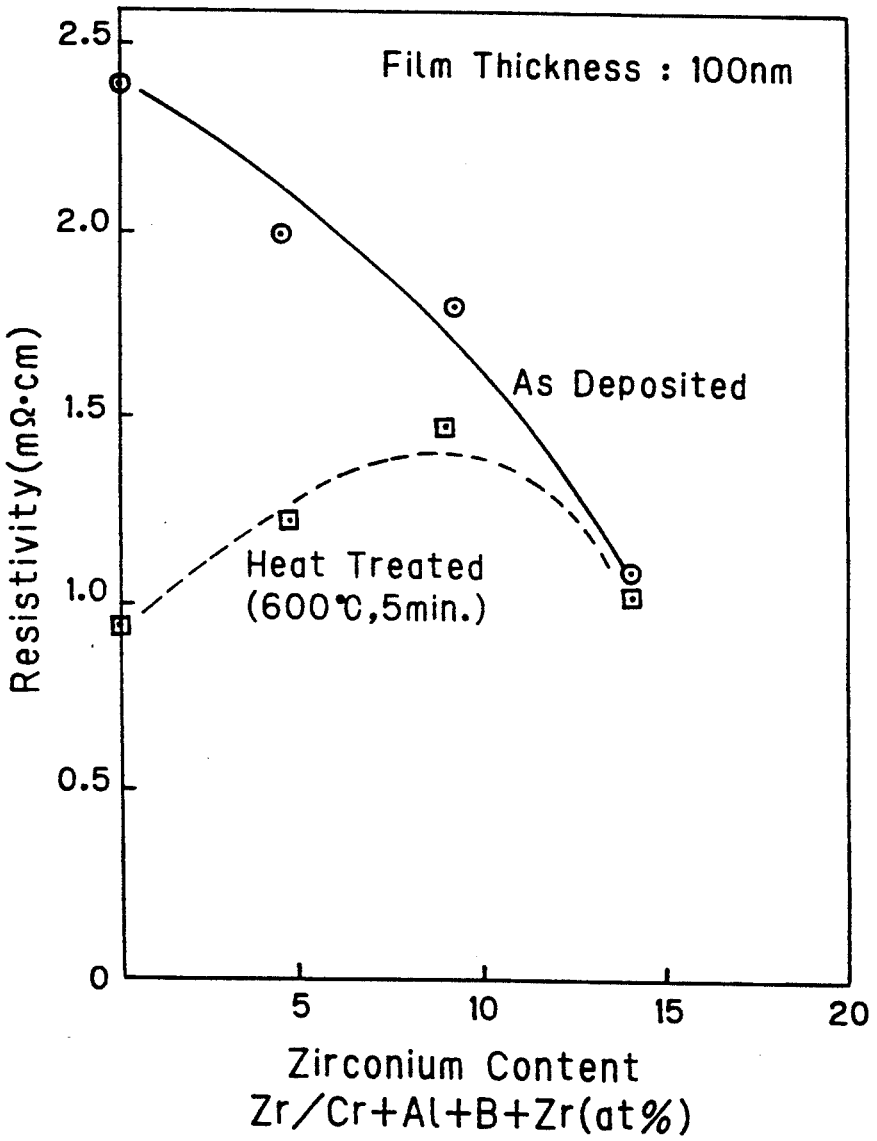
FIG. 2 is a graph showing by way of example the resistivity of a thin film in relation to the proportion of zirconium added to a Cr—Al—B ternary alloy.
Figure 3:
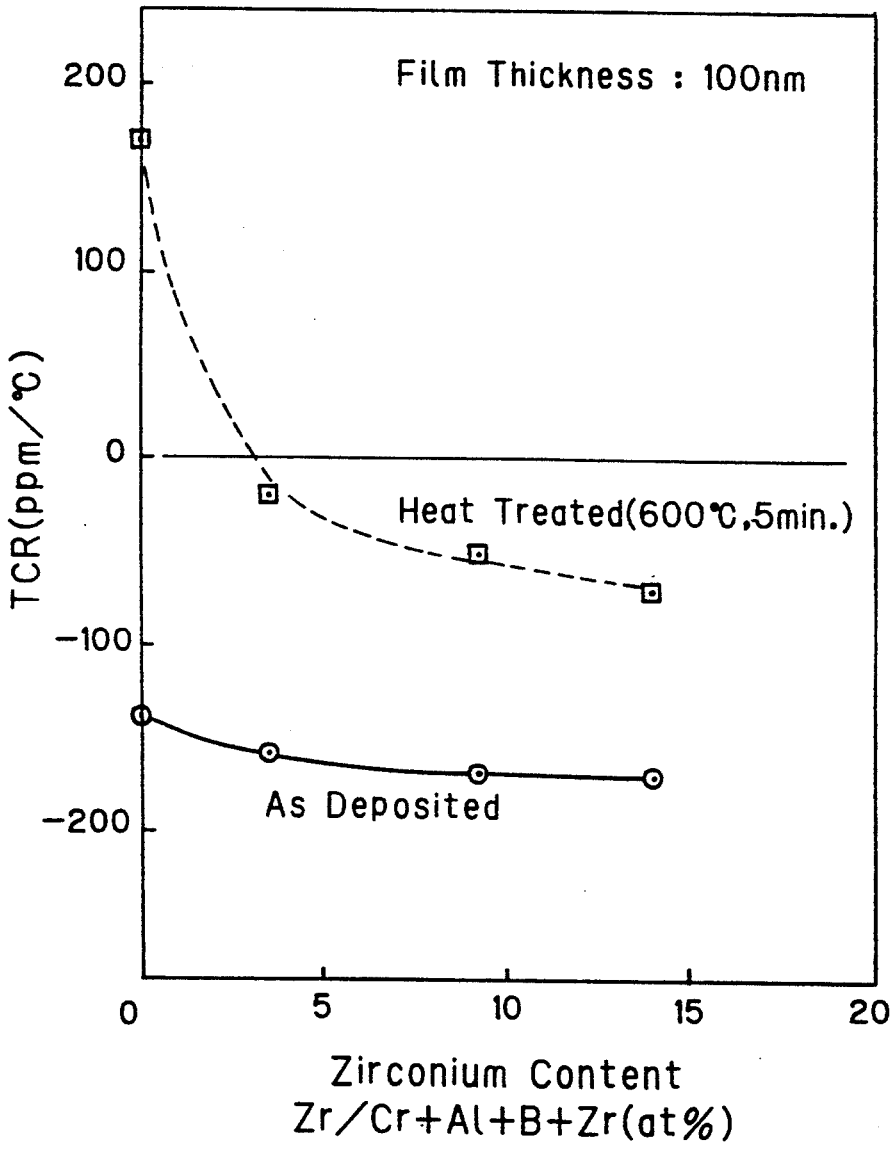
FIG. 3 is a graph showing by way of example the temperature coefficient of resistance of the thin film in relation to the proportion of zirconium added to the Cr—Al—B ternary alloy.

FIGS. 2 and 3 show the effects which the proportion of zirconium relative to the Cr—Al—B ternary alloy was found to exert on the electrical properties of the thin films and the thermal stability thereof, respectively. In these experiments, the composition ratio of the Cr—Al—B alloy film was $Cr:Al:B=46^{+6}_{-3}:7^{+1}_{-2}:48^{+4}_{-8}$ (at %), and the proportion of oxygen to the Cr—Al—B—Zr quaternary alloy was 20 at %.

As is obvious from FIG. 2, an increase of zirconium content brought about a reduction in resistivity of the thin films as deposited, but a smaller difference in resistivity between the films as deposited and those after heat treated. As is obvious from FIG. 3, the increase of zirconium content brought about a slightly higher negative temperature coefficient of resistance to the thin films as deposited, but a smaller difference in temperature coefficient of resistance between the films as deposited and those after heat treated. It was, thus, confirmed that the addition of zirconium to a Cr—Al—B ternary alloy containing oxygen could improve the thermal stability of its electrical properties and produce an electrical resistive material suitable for exposure to a high temperature, as for a heating element for a thermal printing element.

The crystal structure, composition and chemical structure of the thin films were examined by X-ray diffraction micrography and X-ray photoelectron spectroscopy. It was found that zirconium did not bring about any change in the crystal structure of the Cr—Al—B ternary alloy, but allowed it to remain amorphous, and that even after exposure to a high temperature, there was no crystal growth of any chromium-boron compound as had been found in such a ternary alloy before. It was also found, however, that an increase of temperature brought about a greater bond between zirconium and oxygen forming some zirconium oxide crystals. It is, therefore, apparent that the fine oxide which zirconium forms in the amorphous ternary alloy upon exposure to a high temperature inhibits the crystallization of any chromium boron compound and thereby a thermal stability of electrical properties of the thin film is improved.

It is also apparent, therefore, that similar results can be expected from the use of niobium or hafnium which is as effective for stabilizing an amorphous structure as zirconium is.

Another set of experiments were made to determine the effect which the proportion of oxygen to a Cr—Al—B—Zr quaternary alloy might have on its resistivity and temperature coefficient of resistance. Thin films were formed by sputtering using an argon gas containing oxygen and a quaternary alloy target containing 36 at % of chromium, 5 at % of aluminium, 37 at % of boron and 22 at % of zirconium. The oxygen density of the argon gas was varied to form thin films containing different proportions of oxygen. In these experiments, the composition ratio of the $Cr:Al:B=49^{+2}_{-3}:3\pm2:48\pm4$ (at %), and the proportion of zirconium to the Cr—Al—B alloy was $14\pm1$ at %.

Figure 4:
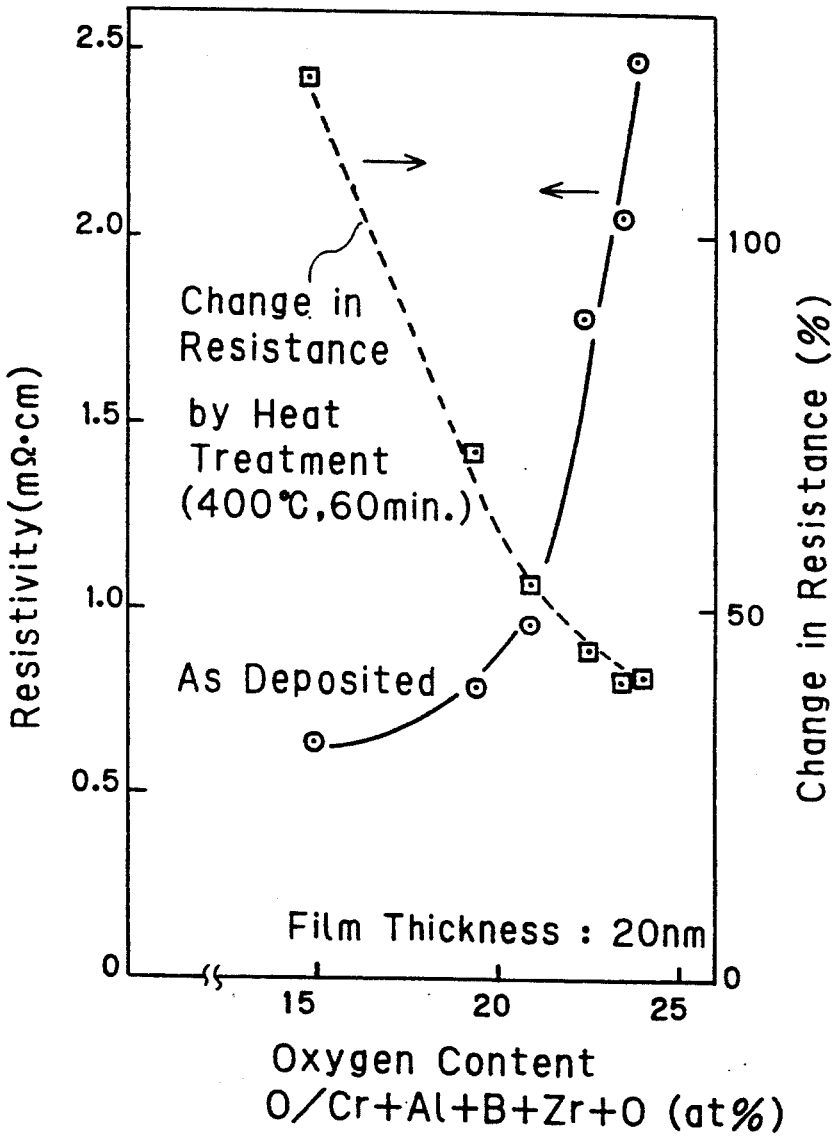
FIG. 4 is a graph showing by way of example the resistivity of a thin film in relation to the proportion of oxygen added to a Cr—Al—B—Zr quaternary alloy.
Figure 5:
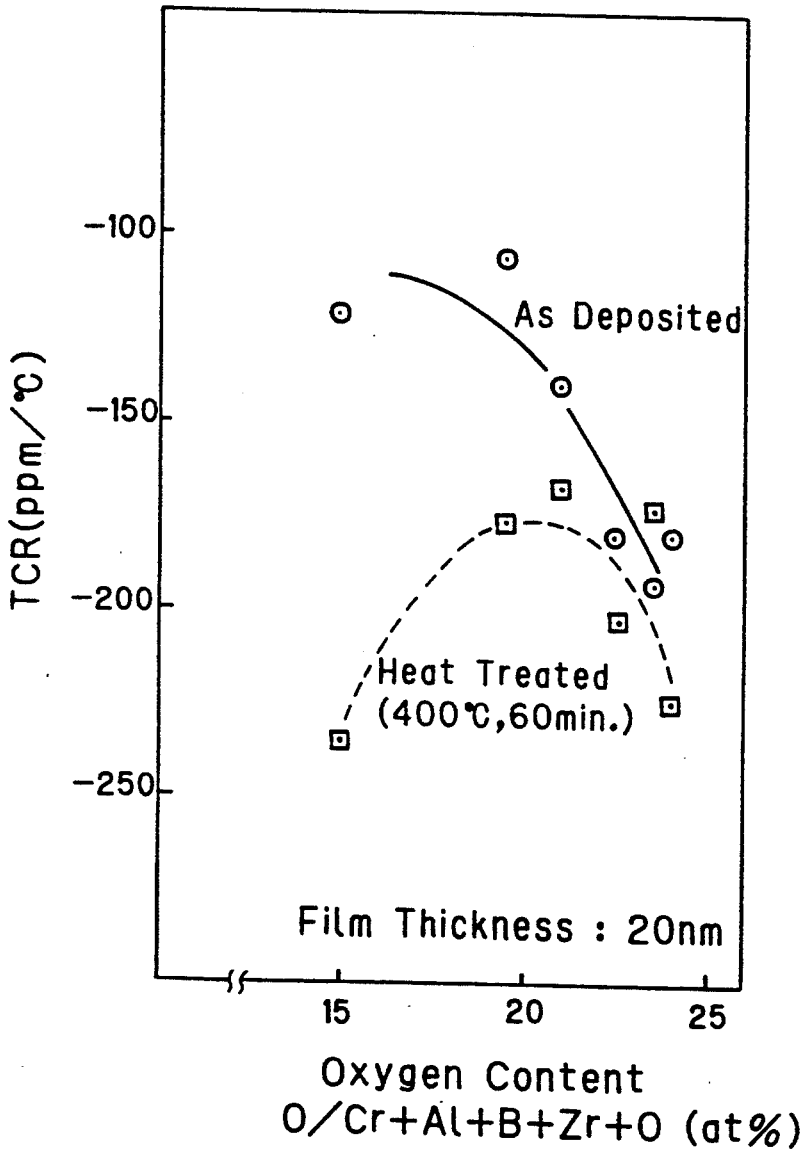
FIG. 5 is a graph showing by way of example the temperature coefficient of resistance of the thin film in relation to the proportion of oxygen added to the Cr—Al—B—Zr quaternary alloy.

The resistivity of the thin films as deposited showed a drastic increase with an increase of oxygen content, as is obvious from FIG. 4, and the absolute value of their negative temperature coefficient of resistance showed a similar tendency, as is obvious from FIG. 5. The increase of oxygen content contributed also to reducing any change occurring to the resistivity of the films and their temperature coefficient of resistance as a result of heat treatment, as is obvious from FIGS. 4 and 5. These results confirmed that the combination of zirconium and oxygen in the thin films improved the thermal stability of their electrical properties. It can, thus, be concluded that a reduction of resistivity of a thin film of a Cr—Al—B alloy caused by adding zirconium is suppressed by increasing the oxygen content of the film and its thermal stability is also improved.

Figure 6:
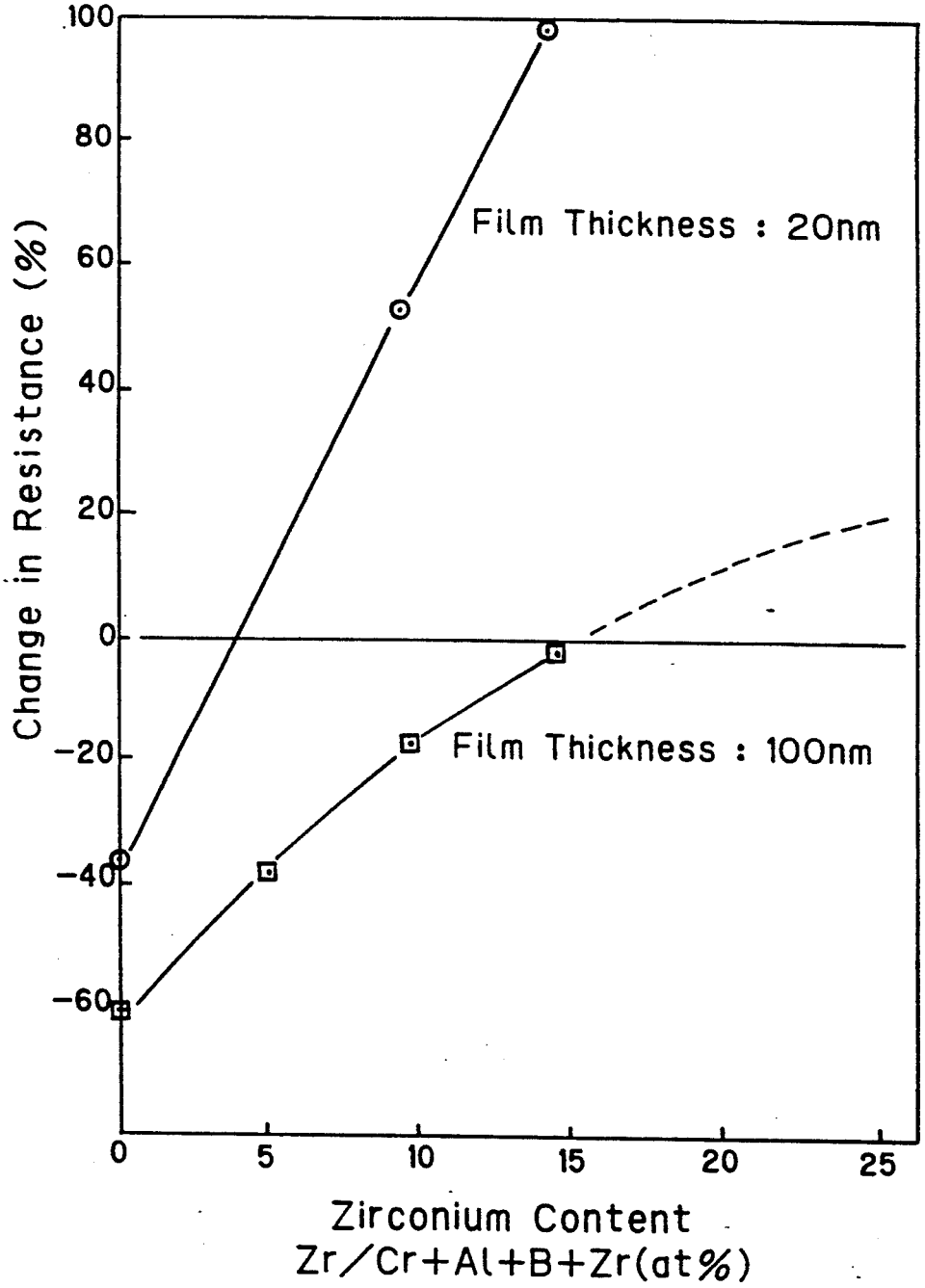
FIG. 6 is a graph showing by way of example a change in electric resistance of a thin film by five minutes of heat treatment at 600 ° C. in relation to the proportion of zirconium added to a Cr—Al—B ternary alloy.

Still another set of experiments were conducted on thin films of a Cr—Al—B—Zr alloy having different thickness to determine the effect which the proportion of zirconium might have on any change occurring to their electric resistance as a result of heat treatment. The results are shown in FIG. 6. Although the thin films not containing zirconium showed a substantial reduction in electric resistance as a result of heat treatment, the films containing zirconium showed a lower percentage of reduction in electric resistance. Particularly, no change in resistance was found in the film having a thickness of 20 nm and containing 3 to 4 at % of zirconium, or the film having a thickness of 100 nm and containing 14 to 16 at % of zirconium. It is, therefore, apparent that the proportion of zirconium in a thin film which enables it to be free from any change in electrical resistance when heat treated depends on its thickness, and that it is necessary to increase the proportion of zirconium to make a thin film having a greater thickness and yet not undergoing any change in electric resistance as a result of exposure to heat.

It is generally believed that a thermal printing element ends its life when the resistance of its heating element has made a change of ±10 to ±20%. Therefore and also in view of the results shown in FIG. 6, it can be concluded that from 2 to 25 at % is the optimum proportion of zirconium for a thin film having a thickness of 20 to 100 nm which is usually employed for a thermal printing element, and that if a wider range of thickness is allowable, it is possible to make a thin film having a zirconium proportion of 1 to 30 at % and yet a greatly improved thermal stability of electrical properties.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrical resistive material comprising:

i) a Cr—Al—B—Zr quaternary alloy comprising:

a) a ternary alloy comprising:

i) 35–55 atomic % or Cr;

ii) 2–23 atomic % of Al; and iii) 37–58 atomic % of B; and b) 2–25 atomic % of Zr, based on the total of Cr, Al, B, and Zr; and ii) 15–25 atomic % of oxygen based on the total of Cr, Al, B, Zr and O.

2. The electrical resistive material of claim 1, wherein said material is in the form of a thin film, having a thickness of 20–100 nm, formed on the surface of an electrical insulating substrate.

3. The electrical resistive material of claim 2, wherein said substrate is a ceramic substrate.

* * * * *